US005431815A

United States Patent [19]

Te-Shin

[11] Patent Number: 5,431,815

[45] Date of Patent: Jul. 11, 1995

[54] DRAINAGE AND COUPLING ADAPTER FOR A FLUID CONDUIT

[76] Inventor: Tseng Te-Shin, Suite 1, 11F, 95-8 Chang Ping Road Sec. 1, Taichung, Taiwan

[21] Appl. No.: 876,028

[22] Filed: Apr. 30, 1992

[51] Int. Cl.[6] ..... B01D 35/02

[52] U.S. Cl. ..... 210/459; 52/302.7; 137/625.32; 138/89; 138/96 R; 210/463

[58] Field of Search ..... 210/163–166, 210/323.1, 418, 430, 460, 463, 435, 429, 459; 52/220, 302.7; 137/625.32; 138/89, 92, 96 R

[56] References Cited

U.S. PATENT DOCUMENTS

| | | | |
|---|---|---|---|
| 1,681,394 | 8/1928 | Carlson | 137/625.32 |
| 1,739,067 | 12/1929 | Fleming | 210/164 |
| 1,805,816 | 5/1931 | Fleming | 210/165 |
| 2,695,678 | 11/1954 | Sisk | 210/165 |
| 3,285,289 | 11/1966 | Titus | 138/89 |
| 3,552,441 | 1/1971 | Luhleich | 138/89 |
| 4,313,286 | 2/1982 | Harbeke | 52/220 |
| 4,883,590 | 11/1989 | Papp | 210/460 |
| 5,099,887 | 3/1992 | Hooper | 138/89 |
| 5,154,024 | 10/1992 | Noel | 210/163 |

*Primary Examiner*—Joseph W. Drodge

[57] ABSTRACT

An adapter for a fluid conduit comprises a stepped diameter tubular member having an enlarged end portion with a plurality of piercable recesses formed thereon, a generally cup shaped obturator, and a removable sieve disposed therein. The recesses formed around the outer periphery of the enlarged end portion can be selectively pierced so as to form fluid passages with the perforated end portion acting as a filter for drainage water entering the adapter. The open end of the adapter and any perforations formed thereon can be closed off by inserting the cup shaped obturator therein. The sieve is similarly provided with piercable recesses thereon and can function as a secondary internal filter. A further fluid conduit can subsequently be connected to the adapter by inserting an end thereof into the adapter until abutment with the inner shoulder therein is reached.

12 Claims, 5 Drawing Sheets

DRAINAGE AND COUPLING ADAPTER FOR A FLUID CONDUIT

BACKGROUND OF THE PRESENT INVENTION

The present invention relates to an adapter for a fluid conduit and more particularly to an adapter that enables the fluid conduit to function as a filtered drain while also facilitating the joining therethrough of another fluid conduit.

The drainage and coupler adapter of the present invention finds its greatest utility at construction sites wherein many fluid conduits or piping protrude vertically through a floor still under construction. Referring to FIG. 1, such conduits i or pipes are usually closed off with a short section of tubing 2 in which the upper end thereof has been flame fused and constricted shut so as to prevent the entrance of any foreign substances or objects prior to attachment of a further conduit or fixture. Though functional, this arrangement is generally time consuming and troublesome to implement which, moreover, precludes the use of the conduit as a temporary water drain for any precipitation that may occur while the floor is still undergoing construction.

Whereas, the adapter of the present invention provides a means of obturating an attached fluid conduit that is both quick and requires no extraneous tools, and which can be selectively opened to provide a clog free drain. Further, the adapter can function as a permanent coupler to another conduit or fixture.

SUMMARY OF THE PRESENT INVENTION

The present invention has as a primary object to provide an adapter for a fluid conduit, or that is an integral part thereof, that can function as a filter for fluids passing therethrough and subsequently as a coupler for facilitating attachment of a further fluid conduit.

In accordance therewith, the filter and coupling adapter comprises a tubular element having an open end portion with a plurality of piercable recesses formed thereon, and a sieve member removably positioned therein. Piercing of the recesses forms a plurality of fluid passages around the periphery of the tubular element so as to define a filter for fluids passing therethrough which is further filtered by the sieve member before passing to the fluid conduit.

The adapter of the present invention has a secondary object of providing a means of closing off the opening of the adapter, to such end a generally cup shaped obturating element is included therewith that enables the selective opening or closing of the adapter prior to or after piercing of the recesses thereon.

The open end portion of the adapter is further adapted to receive a corresponding end of a fluid conduit or related appendage for securement therein after removal of the obturating element.

A detailed description of a preferred exemplary embodiment of the present invention and variations thereof are provided below along with accompanying drawings.

DETAILED DESCRIPTION OF THE PREFERRED EMBODIMENT

Figure 1:
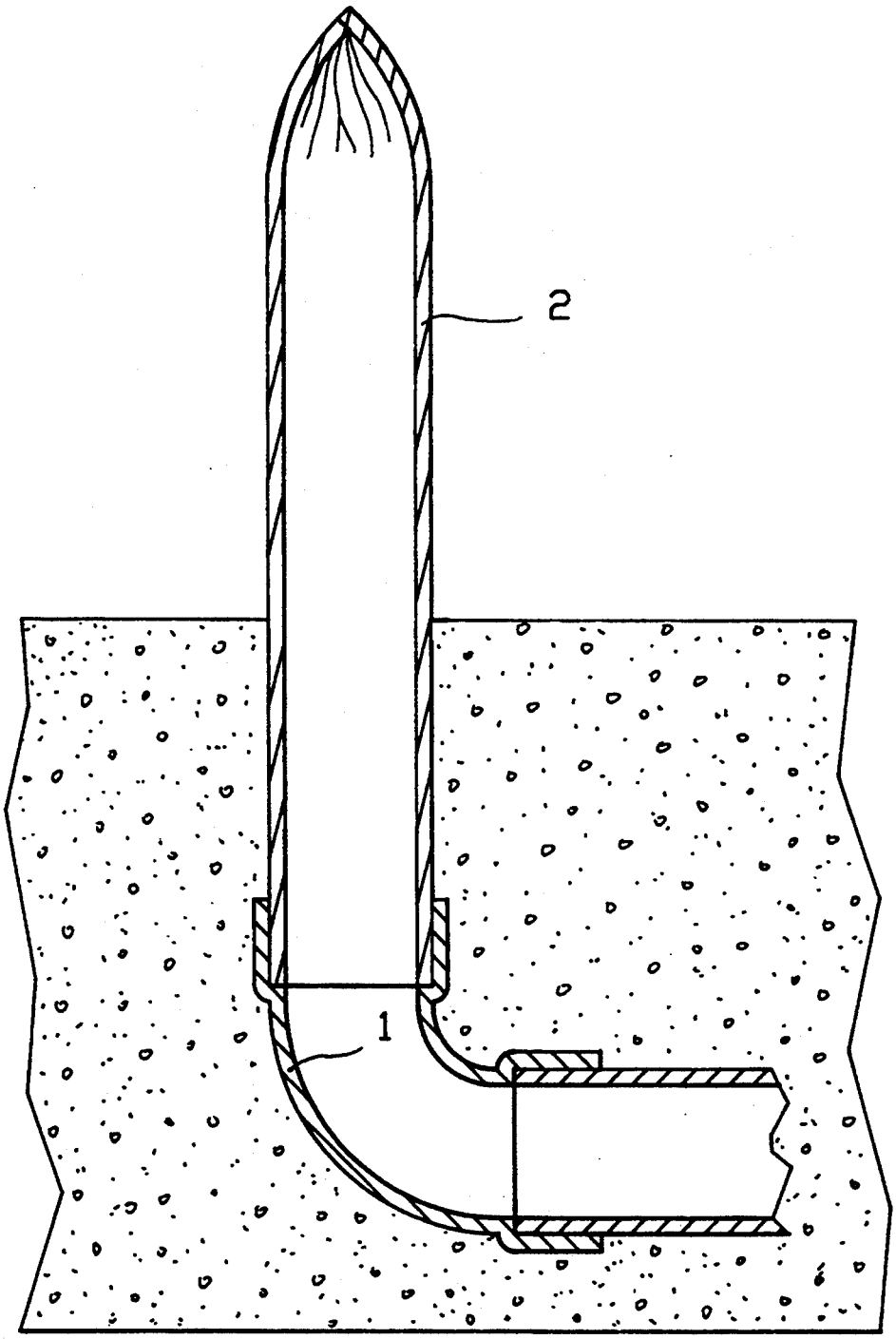
FIG 1 PRIOR ART
FIG. 1 is a sectional view showing a conventional means of temporarily obturating an exposed fluid conduit.
Figure 2:
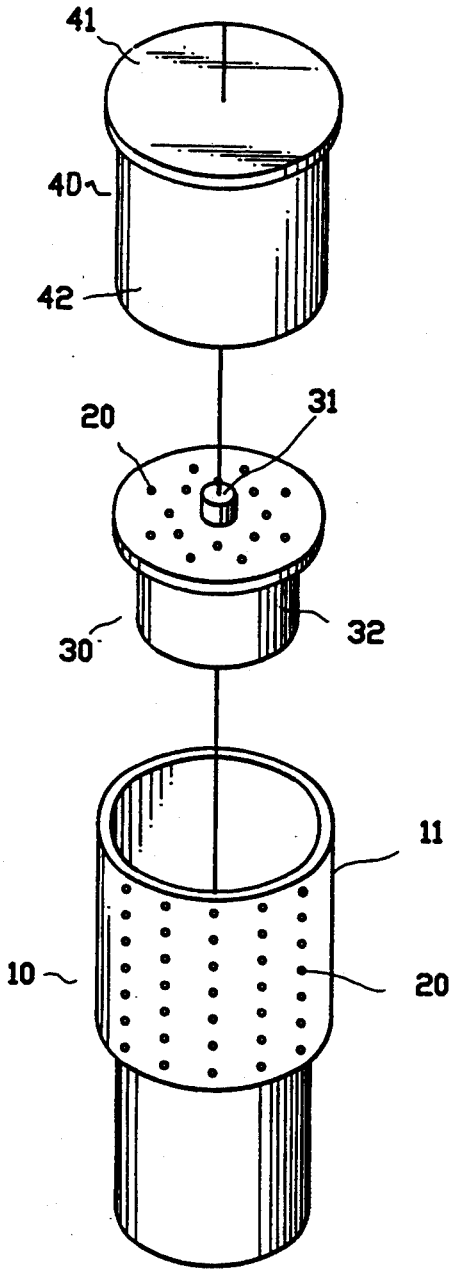
FIG. 2 is an exploded perspective view of the drainage and coupling adapter of the present *invention.

Referring to FIG. 2, the attachment for a fluid conduit of the present invention comprises a stepped diameter tubular member 10, a generally disk shaped sieve 30 disposable therein, and a generally cup shaped obturator 40.

A plurality of piercable recesses 20 ape formed around the outer periphery of the enlarged upper end portion 11 of the tubular member, with the recesses being arranged in five circumferential rows or bands thereon. The recesses extend radially inward and are of sufficient depth to enable the ready impalement of the tubular member by an appropriate hand tool such as a sharp pick like instrument so as to form apertures extending therethrough to the inner periphery of the end portion 11.

Sieve 30 has a plurality of similarly adapted piercable recesses 20' formed on the upper side thereof on which a vertical projection 31 is also formed to facilitate extraction of the sieve from the tubular member. A lesser diameter cylindrical sleeve 32 on the lower side of the sieve fittable against an inner periphery of the tubular member facilitate the positioning of the sieve therein.

Figure 2B:
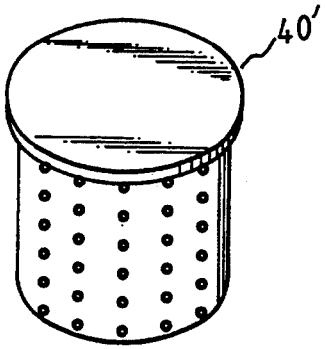
FIG. 2*b* shows an alternate obturating member of the drainage and coupling adapter.
Figure 2A:
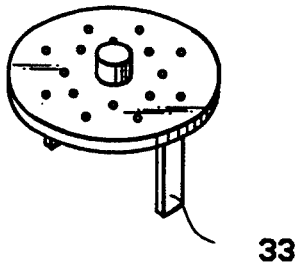
FIG. 2*a* shows an alternate sieve member of the drainage and coupling adapter.
Figure 2C:
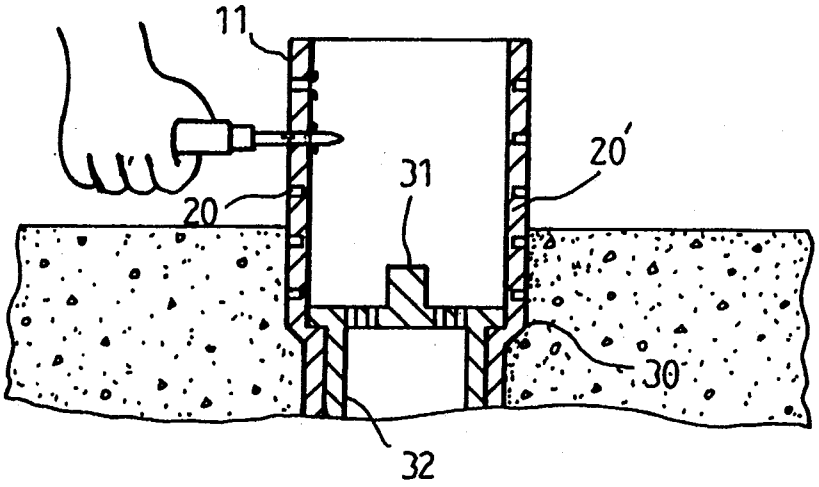
FIG. 2*c* shows the manual piercing of a recess on a tubular member of the tubular adapter to form a fluid passage.

Alternately, a set of vertical supporting extensions 33 similarly provided around the lower periphery of the sieve, as shown in FIG. 2*a*, could also be implemented.

Obturator 40 comprises a rimmed, circular flange 41 and a cylindrical sleeve 49, extending downward therefrom. Sleeve 49, has an outer diameter substantially equal with that of the inner section of the upper end portion of the tubular member, being insertable therein and having a comparable length.

All members of the adapter are manufactured by injection molding from a PVC based compound having predetermined characteristics and as such the adapter is very readily joined with pipes or conduits that are made from a similar material. Furthermore, the soft plastic material is readily punctured by a sharp metal tool within the area of the piercable recesses on the tubular member 10 and sieve 30.

Figure 3:
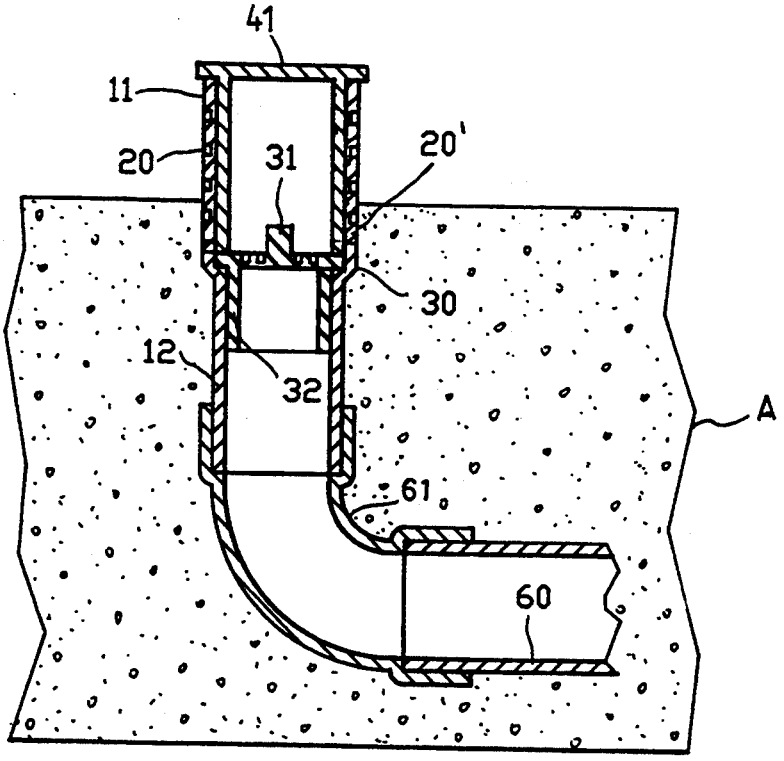
FIG. 3 is a sectional view showing the drainage and coupling adapter connected to a fluid conduit with the obturating member positioned thereon.

As shown in FIG. 3, the lesser diameter lower end 19, of the tubular member is joined with an embedded pipe 60 via an elbow connector 61 using conventional sealing adhesives. With the obturator in place within end portion 11 of the tubular member, the exposed upper end of the member is closed to prevent the entrance of rain water or other undesirable agents.

Figure 4:
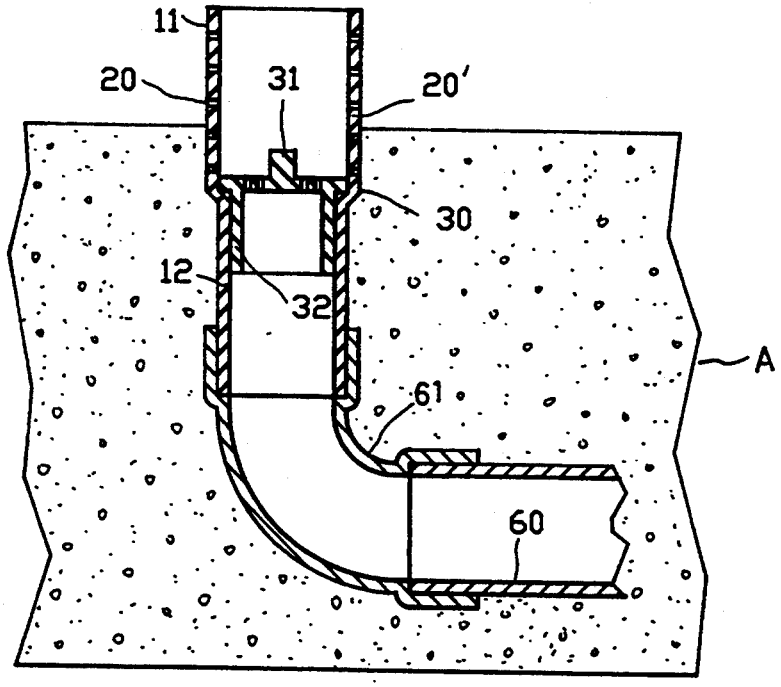
FIG. 4 is a sectional view showing the coupling and drainage adapter of FIG. 3 with the obturating member removed and fluid passages formed at selected peripheral positions thereon.

Referring also to FIG. 4, applied cement A covers the first two rows of recesses 20 on the periphery of end portion 11 while leaving the upper three rows thereon exposed. The adapter can be made to function as a clog resistant drain for any precipitation that may collect over the cement layer during or after construction by first removing obturator 40 and then piercing the exposed recesses 20 on the adapter and likewise the recesses 20' on the sieve therein with an appropriate instrument such as a pick or screwdriver. In so doing, the pierced recesses 20 and 21' define fluid passing apertures that prevent the passage of detritus such as paper shreds, leaves, rand the like, with the apertures on the internal sieve 30 preferably having a smaller cross-section than those around the exposed periphery of the adapter.

Alternately, as conditions would dictate the sieve 30 can function as an auxiliary obturator if left unpierced or as a flow controlling device by selectively puncturing only a selected portion of the recesses 20' thereon.

Note also that the unpierced lower two rows of recesses 20 on end portion 11 prevent any contact between the cement and the interior of the adapter, preventing any seepage of wet cement into the fluid conduit prior to drying.

The opening of the adapter can once again be closed off by re-inserting obturator 40 therein. Alternately, a perforated obturator 40', as shown in FIG. 2*b*, could also be employed wherein the obturator has a plurality of correspondingly positioned apertures 40$\alpha$ formed thereon which can be brought into registry with apertures 20 on the tubular element. By rotating the obturator 40' through a proper angle, the adapter could thus be selectively opened or shut without removing the obturator.

Figure 5:
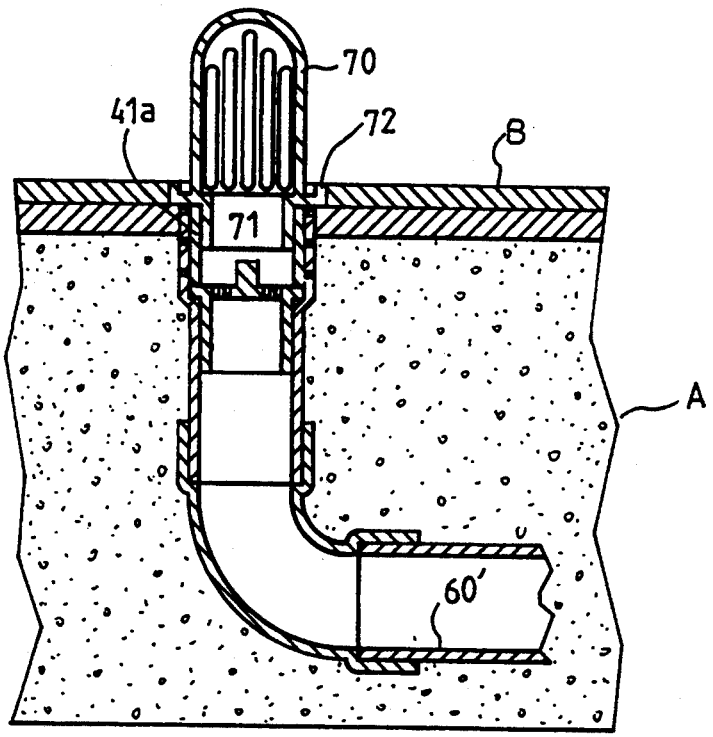
FIG. 5 is a sectional view showing the coupling and drainage adapter of FIG. 4 with a projecting drain gate secured thereover.
Figure 6:
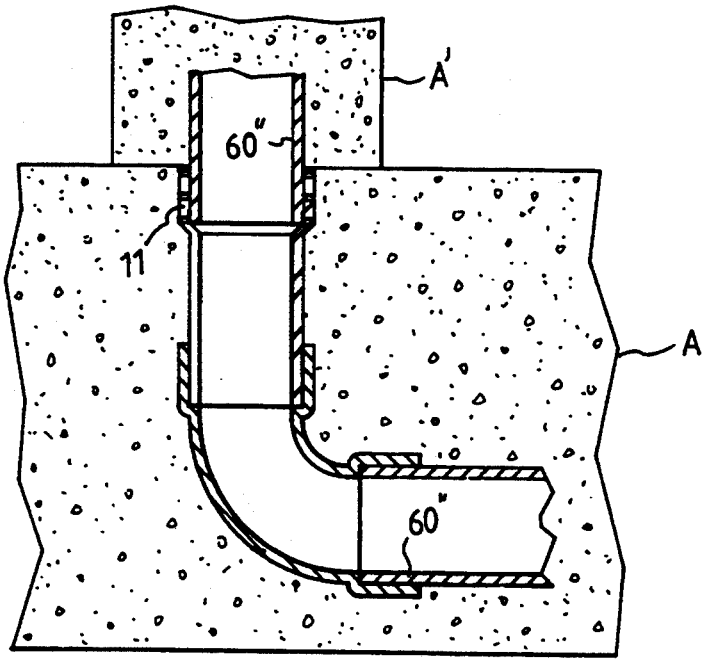
FIG. 6 is a sectional view showing the coupling and drainage adapter coupling a further fluid conduit in a vertical wall to the horizontal conduit.

Referring to FIG. 5, should a conduit 60' be intended to permanently function as a drain pipe, a projecting drain gate 70 can be fixed onto the opening of the adapter after an upper portion of the latter has been sawed off with the obturator having been left in place. A cylindrical lower extension 71 on the drain gate is inserted into the truncated remainder 41*a* of sleeve 41 until a medial flange 72 thereon is in abutment with the rim of the adapter opening. One or more layers B of a flooring or roofing material can then be applied over the dry cement A up to the level of flange 72 on the drain gate to cover the exposed portion of the adapter. The perforated sieve 30 therein can be left in place or removed as required.

FIG. 8 shows how the adapter can subsequently be used as a coupler to a second conduit 60''. Prior to the construction of formwork and the subsequent pouring therein of cement to form a vertical wall A', a conduit 50'' of suitable diameter is inserted into the upper end portion 11 of an adapter from which the obturator and sieve has been removed. The lower end of the conduit rests against the inner shoulder of the adapter and is adhesively secured therein to form a watertight seal.

Further adaptations to suit different environments or specific implementations that have not been described in the above enabling disclosure would be readily apparent to a person skilled in the art, and as such the utility and scope of the present invention should not be construed to be limited to the specific exemplary embodiments described above but instead should be determined from the appended claims and their legal equivalents.

I claim:

1. An adapter for a fluid conduit, comprising a tubular member having a plurality of pierceable recesses provided on an end portion thereon for forming fluid passages the material of said tubular member and the depth of said recesses being such as to enable ready manual impalement by a hand tool so as to form fluid passages, an obturating means for selectively blocking and allowing fluid flow through said end portion; and a removable sieve member disposed in said end portion of said tubular member.

2. An adapter for a fluid conduit according to claim 1, wherein said end portion of said tubular member has a larger cross section than an adjoining portion thereon with an inner shoulder between said end portion and said adjoining portion defining said engagement surface.

3. An adapter for a fluid conduit according to claim 1, wherein said obturating means includes a generally cup shaped member having a peripheral wall which blocks fluid passage through said recesses of said end portion when said cup shaped member is imposed thereupon.

4. An adapter for a fluid conduit according to claim 3, wherein said cup shaped member has a plurality of apertures provided at predetermined positions around said peripheral wall thereof, said apertures being selectively registerable with said recesses of said end portion when said cup shaped member is positioned therein.

5. An adapter for a fluid conduit according to claim 4, wherein said peripheral wall of said cup shaped member abuts an inner periphery of said end portion of said tubular member when said cup shaped member is imposed thereupon by insertion therein.

6. An adapter for a fluid conduit according to claim 5, wherein said obturating means further includes a disk shaped member removably positioned within said end portion of said tubular member, said disk shaped member having a projection formed on one side thereof for facilitating removal of said disk shaped member from said end portion and at least one support element formed on a periphery thereof for abutment with an inner periphery of said end portion.

7. An adapter for a fluid conduit according to claim 6, wherein said disk shaped member has a plurality of recesses formed on a side thereof and forming fluid passages.

8. A fluid conduit, an end portion of said fluid conduit having a plurality of pierceable recesses provided thereon for forming fluid passages the material of said tubular member and the depth of said recesses being such as to enable ready manual impalement by a hand tool so as to form fluid passages; an obturating means for selectively blocking and allowing fluid flow through said end portion; and a removable sieve member disposed in said end portion of said fluid conduit

9. A fluid conduit according to claim 8, wherein said recesses are formed around an outer periphery of said end portion of said fluid conduit; said recesses are arranged in two or more circumferential rows around said end portion of said fluid conduit; said fluid conduit is further provided with an engagement surface on an inner periphery thereof below said end portion for the positioning of a further fluid conduit; said end portion of said fluid conduit has a larger cross section than an adjoining portion thereon with an inner shoulder between said end portion and said adjoining portion defining said engagement surface.

10. In a fluid conduit according to claim 9, wherein said obturating means includes a generally cup shaped member having a peripheral wall which blocks fluid passage through said recesses of said end portion when said cup shaped member is imposed thereupon.

11. In a fluid conduit according to claim 10, wherein said cup shaped member has a plurality of apertures provided at predetermined positions around said peripheral wall thereof, said apertures being selectively registerable with said recesses of said end portion when said cup shaped member is positioned therein.

12. In a fluid conduit according to claim 11, wherein said peripheral wall of said cup shaped member abuts an inner periphery of said end portion of said fluid conduit when said cup shaped member is imposed thereupon by insertion therein.

* * * * *